US006416083B1

(12) United States Patent
Mercier

(10) Patent No.: US 6,416,083 B1
(45) Date of Patent: Jul. 9, 2002

(54) FILING ELEMENTS SUCH AS A SUSPENDED FILE OR FILE FOLDER AS WELL AS A MACHINE FOR THE FABRICATION OF SUCH FILING ELEMENTS

(76) Inventor: Roland Mercier, 98, rue de la Boétie, 75008 Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/070,523

(22) Filed: Apr. 30, 1998

(30) Foreign Application Priority Data

Oct. 30, 1996 (WO) ..... PCT/FR96/01702

(51) Int. Cl.[7] ..... B42D 15/00

(52) U.S. Cl. ..... 283/81; 281/15.1; 281/29; 281/45; 283/36; 283/37; 283/41; 283/64; 283/67; 283/116; 283/114; 283/117; 40/359

(58) Field of Search ..... 283/81, 67, 64, 283/116, 117, 36, 37, 41, 114; 40/359; 281/15.1, 29, 45

(56) References Cited

U.S. PATENT DOCUMENTS 4,050,719 A 9/1977 Cunningham
4,204,639 A * 5/1980 Barber et al. ..... 283/41
4,715,621 A * 12/1987 Colavito et al. ..... 283/36
5,174,606 A * 12/1992 Hure ..... 40/359
5,197,764 A * 3/1993 Hicinbothem et al. ..... 283/81
5,288,107 A * 2/1994 Johnson et al. ..... 283/81
5,622,758 A * 4/1997 Hollis et al. ..... 283/81
RE36,596 E * 3/2000 Schneider ..... 40/359

FOREIGN PATENT DOCUMENTS

GB 389529 3/1933
GB 1444348 7/1976

* cited by examiner

*Primary Examiner*—A. L. Wellington
*Assistant Examiner*—Mark T. Henderson
(74) *Attorney, Agent, or Firm*—Schnader Harrison Segal & Lewis LLP

(57) ABSTRACT

The present invention pertains to a filing element such as a suspended file or file folder for the introduction of documents and an identification strip, characterized in that the identification strip exhibits at least one series of sites, each of which is identified by an alphanumeric labeling that is permanent and invariable for the totality of the elements of a filing system, with one of the sites of the series also having at least one colored identification labeling, with the choice of the labeling colors and the labeling site being specific to the given filing element.

9 Claims, 2 Drawing Sheets

21
15
16
17
18
19
34
14
20
33

30
31
36
37
35
32
38
39

FILING ELEMENTS SUCH AS A SUSPENDED FILE OR FILE FOLDER AS WELL AS A MACHINE FOR THE FABRICATION OF SUCH FILING ELEMENTS

BACKGROUND OF THE INVENTION

1. Field of the Invention

The present invention pertains to filing elements, such as suspended files or file folders, as well as a machine for the fabrication of such filing elements.

2. Description of the Related Art

Already known in the state of the art are filing elements constituted by suspended files or file folders for arranging archives. Such files generally exhibit identification zones that enable retrieval of the file. The identification zone can be constituted by a projecting part on which inscriptions are affixed, by an identification tab, or by protruding tabs into which identification strips can be slipped.

Also known are filing elements comprising a labeling zone that can receive alphanumeric information coupled with a colored labeling.

All of these classification elements have the drawback of imposing an immutable filing order. A filing element which is not filed in its usual place will be very difficult to find.

Also known is U.S. Pat. No. 4,050,719 disclosing a filing element such as a suspended file exhibiting an identification strip comprising a series of positions identified by a permanent alphanumeric labeling. The visibility of this identification strip is not always satisfactory when the filing elements according to this patent are juxtaposed in a compact row.

SUMMARY OF THE INVENTION

The object of the present invention is to resolve this drawback by proposing filing elements that make it possible to read the identification strip under all conditions, notably when the elements are arranged in a tight manner.

For this purpose, the invention pertains more specifically to a filing element and an identification strip exhibiting at least one series of positions each of which is identified by a permanent alphanumeric labeling, with a single one of the positions of said series also carrying at least one colored identification labeling specific to the filing element. The alphanumeric labeling constitutes the reference point of the position of the site that can receive a colored labeling specific to a particular file. The alphanumeric labeling is identical and invariable for all of the files. A given site of a file always carries the same alphanumeric labeling. The identification strip is provided on an extension.

The identification of a particular file is effected by the alphanumeric reference of the site carrying the colored labeling, and by the nature of this colored labeling. Alphanumeric reference is understood to mean a numeral, a letter, an ideogram, or a series of such signs.

The alphanumeric reference will designate the position at which it is agreed that the colored labeling will be found. Colored labeling is understood to mean a full labeling or labeling formed by distinctive geometric patterns such as hatchings, striations, crosses, number signs, asterisks, etc.

The filing elements according to the invention allow a large number of combinations with a reduced number of easy-to-memorize codes.

Advantageously, each of the elements is identified by a labeling of said site of said series formed by a colored binomial or trinomial.

One element can, for example, comprise 10 referenced sites A to J, with the colored labeling being selected from among 6 primary colors, 6 striated colors and 6 stippled colors. This enables 2160 combinations, with only three elements to memorize, of the type "B red green".

The reference "B" would indicate that it is the second site from the top, and in scanning these sites, it would be easy to locate the combination of colors "red green", no matter the position of the file in question in the series of files.

According to a particular mode of implementation, the identification strip has a principal series of sites identified by a first type of alphanumeric labeling, and at least one secondary series of sites identified by one or more secondary types of alphanumeric labeling.

This mode of implementation makes it possible to identify files by a principal code and one or more secondary codes, corresponding for example to the filing zone or the year of creation of the file. The secondary code can be placed before or after the principal code.

According to a preferred mode of implementation, the reference sites have a rectangular shape visible on both sides and carrying at their center an alphanumeric reference, with the colored labeling filling the surface of one of the said rectangular zones except for the part carrying the alphanumeric reference.

Advantageously, the reference sites have a rectangular shape and comprise in their center an alphanumeric reference, with the colored labeling being formed of two parts each filling half of the surface of one of said rectangular zones except for the part carrying the alphanumeric reference.

According to another variant, the identification strip can also have two zones, with the first zone extending from the beginning of the principal series of sites to the middle of the site carrying the first colored labeling binomial, and with the second zone extending from the middle of the second colored labeling binomial to the end of the principal series of sites, with the optical behavior of these two zones being correlated respectively with the first and second labeling of the colored binomial, with the ratio of the lengths of the first and of the second zone making it possible to deduce the site carrying the colored labeling. The colored binomial can be visible or not visible.

According to a particular variant of implementation, the filing element is constituted by a pleated envelope with a side opening, with one of the surfaces of said envelope extending so as to form the identification strip. This variant is particularly suitable for the filing of radiographs.

According to another mode of implementation, the filing element is constituted by an envelope, one surface of which extends so as to form an extension carrying the identification strip. This extension makes it possible to see the colored labeling under different angles, notably in front view, even when the files are filed tightly.

The term "envelope" is understood to mean an element that makes it possible to file sheets or documents, such as, for example, file folders.

Advantageously, said extension is formed by folding an end strip of the envelope, thus forming a part with a polygonal, preferably triangular, cross section. The adhesion of the extension can be implemented by film stripping thereby also ensuring protection of the strip against soiling and wear.

According to a preferred mode of implementation, the filing element according to the invention has an extension formed by folding back a lateral part of the envelope along three parallel scored lines, and by gluing an identification strip on said folded-over part.

The invention also pertains to a machine for the fabrication of filing elements comprising a folding component which receives a pile of scored side pieces, a color printer for affixing a color labeling on an identification strip, means for folding the lateral part of a side piece, and means for adhering the identification strip printed in this manner on the side piece folded in this manner.

According to one variant, the printing of text information on one of the surfaces of the side piece is implemented in coherence with the colored labeling of an identification strip designed to be affixed on said side piece.

Advantageously, the machine according to the invention also has means for printing information on the side piece concordantly with the colored labeling of the identification strip. The colored labeling can be implemented in the visible spectrum or in nonvisible bands, for example detectable in ultraviolet bands.

BRIEF DESCRIPTION OF THE DRAWINGS

Better comprehension of the invention will be provided by the description below with reference to the attached drawings in which.

DETAILED DESCRIPTION

Figure 1:
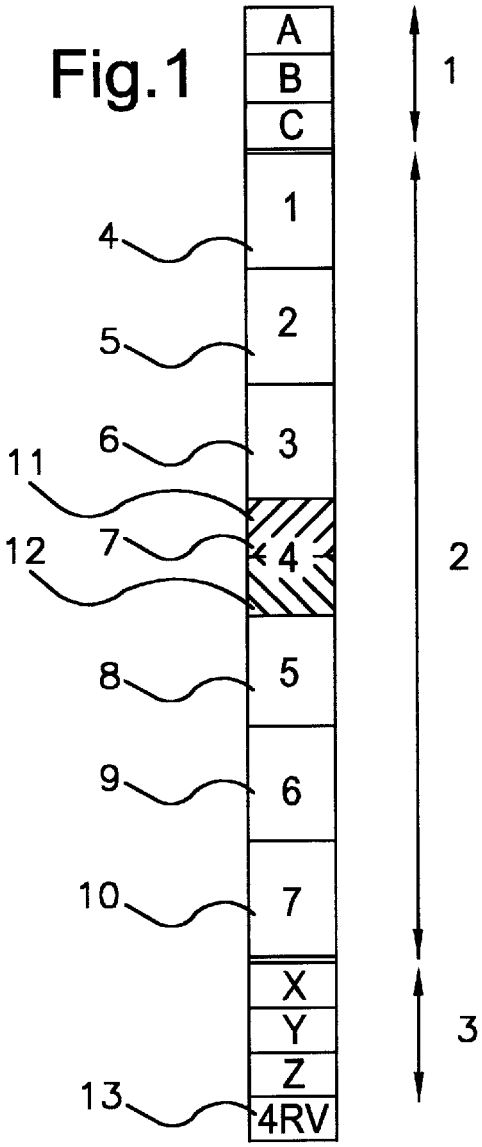
FIG. 1 shows a view of the identification strip of a filing element according to the invention.

FIG. 1 shows an example of an identification strip intended for labeling a suspended file, a binder or any other equivalent type of filing element or case files positioned vertically or horizontally or laterally on a support. The strip has three invariable zones (1, 2, 3) each forming a series of sites. The central zone (2) constitutes the principal labeling series. It is divided into seven sites (4 to 10), each comprising a numeric labeling "1", "2", "3", "4", "5", "6", and "7". This labeling is identical for all of the files in a filing system.

Among the sites (4 to 10), only one has a colored labeling. In the example illustrated in FIG. 1, site (4) has a two-part colored labeling forming a binomial. The colored labeling is formed by two zones (11 and 12). These zones are, for example, "RED" for zone (11) and "GREEN" for zone (12).

This labeling is memorized in the form "4RV" to remember that the site carries the reference "4" for a red mark and a green (or verte, in French) mark. This mnemonic is summarized at the bottom of the document in a site (13). The colored labeling can be preprinted in the context of a batch of files all of which are different, or it can be printed at the time of preparation of the file.

As an example, the colored labelings are selected from among the following colors: red, yellow, green, chestnut, cyan, lilac, blue, orange, black, gray, white (with these colors being memorized on the basis of their first letters, all of which are different (in French)), or among the striated colors, stippled colors, or forming distinctive geometric signs.

The system is employed in the following manner. Upon opening a file on Mr. Jean MARTIN, one takes a new file which has been coded 4RV in advance. One imprints the name Jean MARTIN on the file and one records this name as well as this code in a manual or computerized index.

This file can then be filed anywhere in the filing cabinet. It is easy to find it by looking at the level of line "4" and looking for the combination of colors "RED GREEN". In an associated software program, it is possible to enter into the computer memory this labeling on the basis of the color zones and the alphanumeric references appearing on a color display screen which enables use in any language.

The labeling by colored binomials can also be implemented on secondary zones so as to allow referencings on the basis of supplementary criteria, for example the filing zone or any other criterion.

Figure 2:
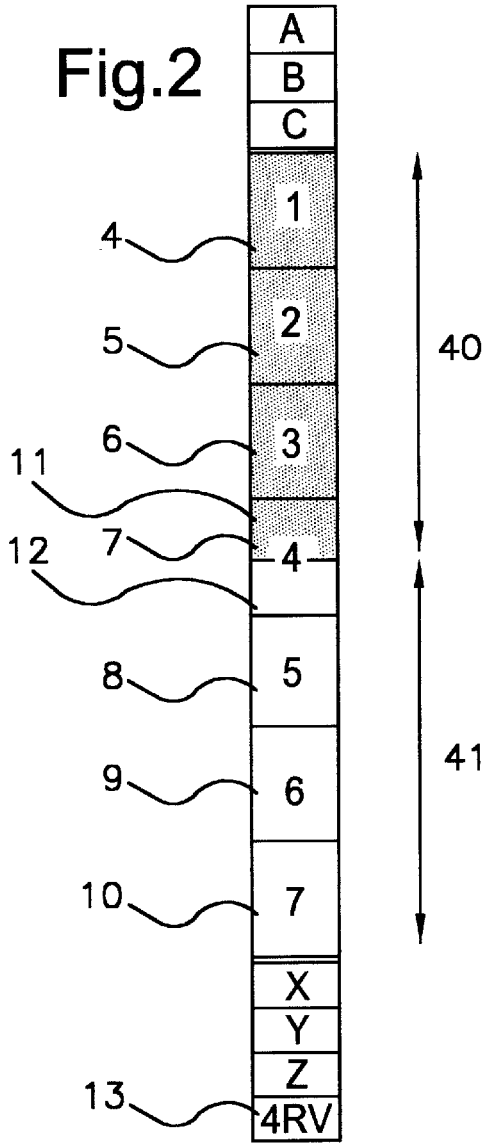
FIG. 2 shows a view of a variant of the identification strip of a filing element according to the invention.

FIG. 2 shows a variant of implementation in which the strip carries a second labeling mode. This second labeling mode is a labeling that is not visible in the visible spectrum, for example an infrared or photoluminescent labeling which is excitable by ultraviolet radiation. The labeling is constituted by two zones (40, 41), with the first zone extending from the beginning of the principal series of sites to the middle of the site (7) carrying the first colored labeling binomial, and with the second zone extending from the middle of the second colored labeling binomial to the end of the principal series of sites. The optical behavior of these two zones is correlated respectively with the first and second colored binomial labeling. The ratio between the length of the first (40) and the second zone (41) makes it possible to deduce the site of the colored labeling. This mode of implementation facilitates the automatic identification of the files.

Figure 3:
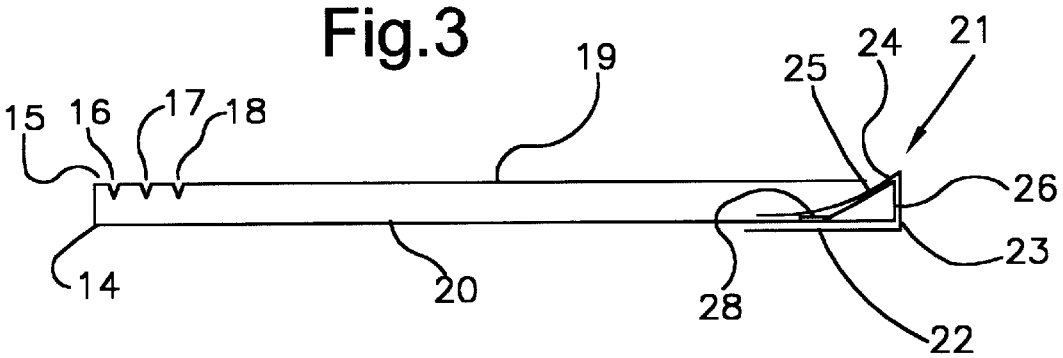
FIG. 3 shows a sectional view of the filing element.

FIG. 3 shows an advantageous mode of fabrication of a file according to the invention. The filing element is constituted by a folder made of 400 gr. bristol board, for example, folded so as to form a folder. The folder is scored along several lines (14 to 18) so that the folder can be adapted to different thicknesses of the documents to be filed.

The recto flap (19) of the folder can carry preprinted information, for example the usual headings following by boxes for the personalization of the file.

The verso flap (20) of the folder protrudes in the form of an extension (21) on which is affixed the identification strip. This extension improves the visibility of the identification strips when the files are tightly arranged in a filing cabinet.

The extension is formed by folding over of the lateral strip of the verso flap (20) along several scored lines (23, 24, 25) which are parallel to each other. In the example described, the extension (21) has a triangular cross section. It is formed by a first strip (26) extending essentially perpendicular to the verso flap (20), then by an intermediate strip (27) extending to the interior surface of the verso flap (20), then by a small strip (28) extending parallel to the interior surface of the verso flap (20). This latter strip (28) is not indispensable. This latter strip (28), when it is present, can be glued to the interior surface of the verso flap (20).

In the example of the implementation shown in FIG. 3, the identification strip projects beyond the extension (21) and is glued on the interior surface of the verso flap (20), on the strips (26 to 28) forming the extension and on the exterior surface of the verso flap (20). The identification band (22) thus maintains the rigidity and the volume of the extension (21).

Figure 4:
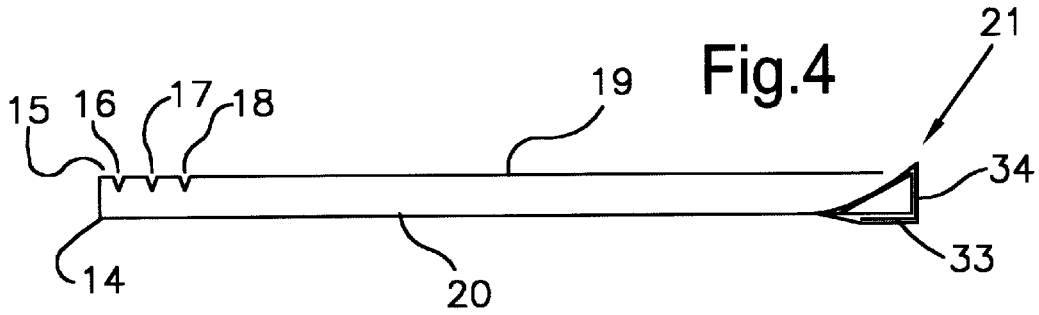
FIG. 4 shows a sectional view of a variant of the filing element.

In the example of the implementation shown in FIG. 4, the identification strip is formed on an extension (21). This strip

(33) is preprinted so as to carry in one part the alphanumeric labelings and, in the other part, the colored personalization labeling of the file. The strip is affixed to the file by a transparent adhesive tape (34) covering the identification strip and projecting from the extension (21) onto the interior and exterior surfaces of the flap. This transparent adhesive tape not only protects the identification strip but also maintains the extension formed by the folding of the edge of one of the flaps. As a variant, the alphanumeric labeling is formed directly on the file on the folding part forming the extension (21). The colored labeling is implemented by means of colored elements superimposed on the reference sites and affixed by means of the adhesive tape.

Figure 5:
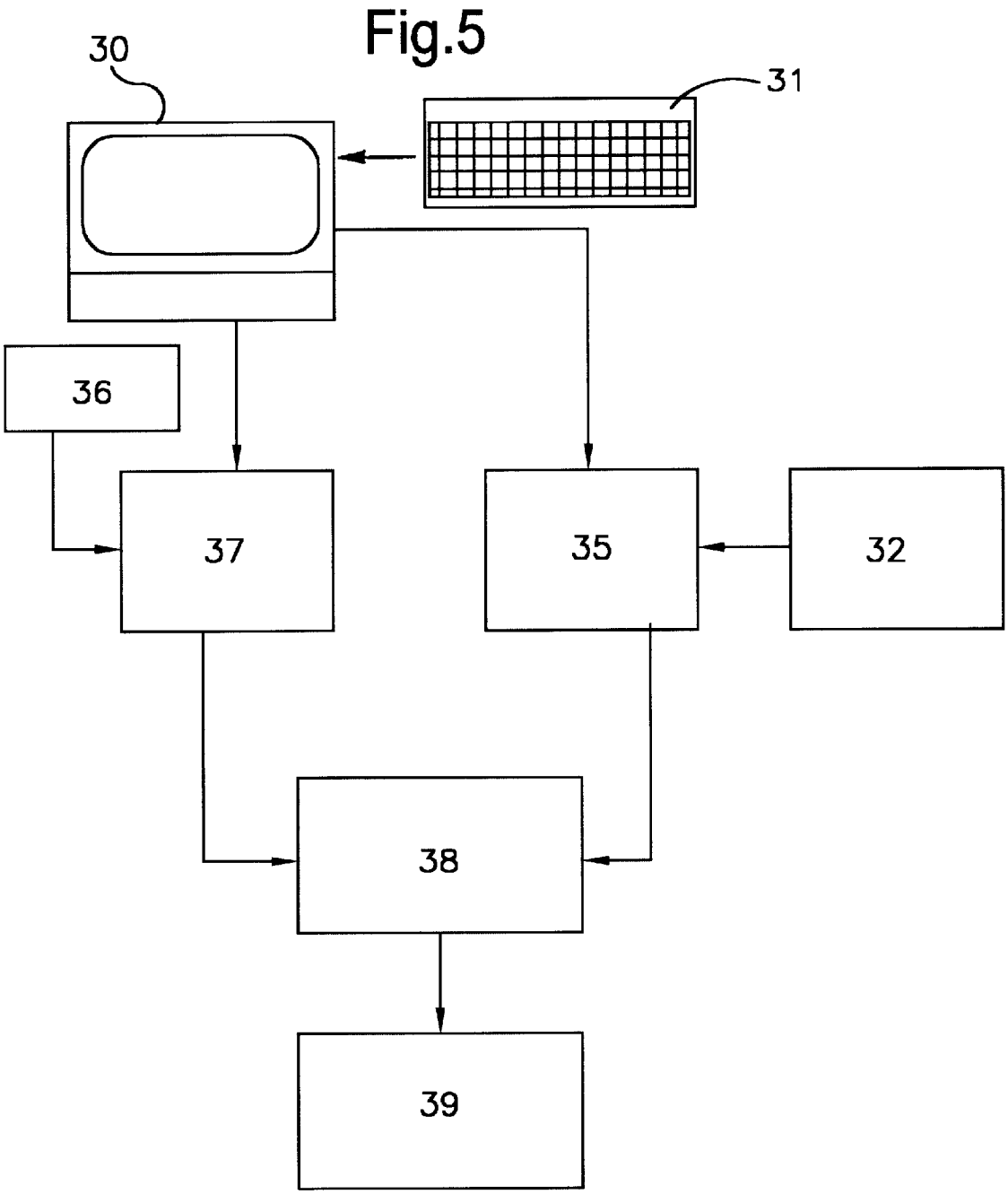
FIG. 5 shows a schematic view of an installation for fabrication of elements according to the invention.

FIG. 5 shows a diagram in principle of an installation for the fabrication of filing elements according to the invention. This installation comprises a computer (30) comprising a file management program, for example a data base enabling the registration of information relative to a file and the corresponding alphanumeric and color combination, as well as searches based on multiple criteria. The usual input means (31) (e.g., a keyboard) makes it possible to input these data when a new file is opened.

The side pieces for the fabrication of the folders are stored in a folding device (32) that feeds a printing station (35). This printing station allows, first of all, conventional personalization based on the printing of text information such as the name of a person, a title, the date of opening a file, etc. This printing station can also be used for the alphanumeric labeling of an identification strip. This solution makes it possible to use side pieces that are completely free of any printing. A black-and-white printing head is sufficient for these first two printings. In the third instance, this printing station can be used for printing the color-code labeling. In this case, it is necessary to have a color printing head.

According to another variant, the printing of the color code is performed at a second printing station (37) that receives a strip originating from a feed station (36) for example, a paper tape dispenser.

This strip prepared in this manner is then fed to a gluing station (38) for the preparation of an extension (21) by folding along the scored lines, and the gluing of the preprinted identification strip on the extension formed in this manner. The file then passes through a lamination or film-stripping station (39) for treating the identification strips.

The invention is described above as a nonlimitative example. The expert in the field could implement different variants thereof without departing from the scope of the invention.

What is claimed is:

1. A filing system comprising a plurality of filing elements, each filing element having an identification strip having 1) a first series of sites, each site identified by a permanent alphanumeric labeling that is uniform for all filing elements of the filing system, wherein for each filing element only a single site in the first series of sites also has an alternate identification labeling, the combination of the single site and alternate identification labeling on the single site uniquely identifying each filing element, with selection of the alternate labeling and the single site being positioned independent of the physical location of the filing element in the filing system and 2) a second series of sites smaller in number than the number of sites in the first series, each site having an alphanumeric labeling, and wherein the alternate identification labeling contains two colors and/or patterns forming a binomial.

2. A filing system comprising a plurality of filing elements, each filing element having an identification strip having 1) a first series of sites, each site identified by a permanent alphanumeric labeling that is uniform for all filing elements of the filing system, wherein for each filing element only a single site in the first series of sites also has an alternate identification labeling, the combination of the single site and alternate identification labeling on the single site uniquely identifying each filing element, with selection of the alternate labeling and the single site being positioned independent of the physical location of the filing element in the filing system and 2) a second series of sites smaller in number than the number of sites in the first series, each site having an alphanumeric labeling, and wherein each site has a rectangular zone and, at its center, an alphanumeric reference, wherein, in the single site, the alternate identification labeling is formed of two parts, each of which fills half of the rectangular zone, excluding the alphanumeric reference.

3. A filing system comprising a plurality of filing elements, each filing element having an identification strip having 1) a first series of sites, each site identified by a permanent alphanumeric labeling that is uniform for all filing elements of the filing system, wherein for each filing element only a single site in the first series of sites also has an alternate identification labeling, the combination of the single site and alternate identification labeling on the single site uniquely identifying each filing element, with selection of the alternate labeling and the single site being positioned independent of the physical location of the filing element in the filing system and 2) a second series of sites smaller in number than the number of sites in the first series, each site having an alphanumeric labeling, and wherein the identification strip has a first zone characterized by a first zone length extending from one end of the first series of sites to a point located centrally within the single site, and a second zone characterized by a second zone length extending from said point to the other end of the first series of sites, with the optical beheavior of the first and second zones being correlated respectively with first and second colored binomial labelings of the single site, with the ratio of the first zone length to the second zone length, enabling identification of the single site.

4. A filing system, comprising a plurality of file elements for storing and retrieving articles Comprising a file jacket adapted to hold an article, the file jacket having an exterior surface, and an identification strip positioned at a preselected location on the exterior surface, the identification strip exhibiting a plurality of indelible alphanumeric labels aligned longitudinally in a series, each label disposed centrally within a site having a fixed area, in which the labels and the location of the identification strip are identical on every file element of the filing system, and in which the fixed area of only one site in the series on each identification strip is colored with a visible color scheme selected from a predefined range of colors or patterns, defining a solely colored or patterned site, so that the color or pattern scheme together with the alphanumeric label of the solely colored or patterned site uniquely identify each file element in the system.

5. The filing system of claim 4 in which each file element holding an article is placed in a storage location in the file system, and further comprising an index having a plurality of records, each record of which comprises a description of the article held in a specific file element and a code corresponding to the alphanumeric label and the color scheme of the solely colored site associated with the specific file element but which records do not include information that identifies the storage location of file elements.

6. The filing system of claim 4, in which the identification strip of each file element holding an article has a first zone characterized by a first zone length extending from one end of the series of sites to a point located centrally inside the fixed area of the solely colored site, and a second zone characterized by a second zone length extending from said point to the other end of the series of sites, in which the first zone has a first non-visible spectrum marking corresponding according to a coding scheme to one identifying feature of the visible color scheme of the solely colored site, and the second zone has a second non-visible spectrum marking corresponding according to the coding scheme to a different identifying feature of the visible color scheme of the solely colored site.

7. The filing system of claim 6 in which each file element holding an article is placed in a storage location in the file system, and further comprising an index having a plurality of records, each record of which comprises a description of the article held in a specific file element, a code corresponding to the alphanumeric label and the color scheme of the solely colored site associated with the specific file element, a code corresponding to the first non-visible spectrum marking, a code corresponding to the second non-visible marking, and the ratio of the first zone length to the second zone length, but which records do not include information that identifies the storage location of file elements.

8. A filing system comprising a plurality of filing elements, each filing element having an identification strip having 1) a first series of sites, each site identified by a permanent alphanumeric labeling that is uniform for all filing elements of the filing system, wherein for each filing element only a single site in the first series of sites also has an alternate identification labeling, a combination of the single site and alternate identification labeling on the single site uniquely identifying each filing element, with selection of the alternate labeling and the single site being positioned independent of a physical location of the filing element in the filing system and 2) a summary site having an alphanumeric representation summarizing a combination of the single site and alternate identification labeling.

9. A filing system, comprising a plurality of file elements for storing and retrieving articles comprising a file jacket adapted to hold an article, the file jacket having an exterior surface, and an identification strip positioned at a preselected location on the exterior surface, the identification strip exhibiting a plurality of indelible alphanumeric labels aligned longitudinally in a series, each label disposed centrally within a site having first and second fixed areas, in which the labels and the location of the identification strip are identical on every file element of the filing system, in which the first fixed area of only one site in the series on each identification strip is colored with a visible color scheme selected from a predefined range of colors or patterns, defining a solely colored or patterned site, so that the color or pattern scheme together with the alphanumeric label of the solely colored or patterned site uniquely identify each file element in the system, and in which the second fixed area combines summary information about the alphanumeric label and the colored or patterned site.

* * * * *